United States Patent [19]

Miller

[11] 4,034,026

[45] July 5, 1977

[54] MULTI-FUNCTION FLUID INLET VALVING MEANS AND RESERVOIR MEANS

[75] Inventor: Robert J. Miller, Warren, Mich.

[73] Assignee: Colt Industries Operating Corporation, New York, N.Y.

[22] Filed: Apr. 30, 1976

[21] Appl. No.: 682,117

[52] U.S. Cl. ..... 261/23 A; 123/32 ST; 137/411; 137/428; 137/451; 261/70; 261/DIG. 50

[51] Int. Cl.[2] ..... F02M 5/02

[58] Field of Search ..... 261/23 A, DIG. 50, 70; 123/32 ST; 137/411, 428, 451

[56] References Cited

UNITED STATES PATENTS

| | | | |
|---|---|---|---|
| 1,746,302 | 2/1930 | Bronander | 261/70 |
| 1,748,332 | 2/1930 | Ensign | 261/70 |
| 2,227,405 | 12/1940 | Brown | 137/411 |
| 2,635,625 | 4/1953 | Moseley et al. | 137/428 |
| 2,801,645 | 8/1957 | White | 137/411 |
| 2,855,949 | 10/1958 | Sterner et al. | 261/70 |
| 3,372,912 | 3/1968 | Benmore | 261/DIG. 50 |
| 3,842,810 | 10/1974 | Yagi et al. | 123/32 ST |

FOREIGN PATENTS OR APPLICATIONS

| | | | |
|---|---|---|---|
| 736,475 | 9/1932 | France | 137/428 |

*Primary Examiner*—Tim R. Miles

[57] ABSTRACT

A fuel carburetor structure is shown having a main fuel bowl or reservoir with a second fuel reservoir therein; a fuel inlet valve assembly for controlling the rate of fuel flow to both the main and second or auxiliary reservoirs is shown as having a needle-like inlet valve positioned by a float carried within the main reservoir and responsive to the level of the fuel contained therein; additional valving means resiliently resists the flow of fuel into the main reservoir and the degree of such resilient resistance is reflective of the degree to which the needle-like inlet valve has been moved toward its fully closed position; the additional valving means also serves to cause a flow of fuel from the needle-like inlet valve to the auxiliary reservoir via related conduit means.

4 Claims, 6 Drawing Figures

MULTI-FUNCTION FLUID INLET VALVING MEANS AND RESERVOIR MEANS

BACKGROUND OF THE INVENTION

In many situations involving fluid flows, it often happens that a single source of such fluid must supply such fluid in a manner whereby the fluid is, for example, controlled by single valving assembly means but effectively directed to two physically distinct receiving areas. This problem has arisen, for example, in connection with carburetor structures intended to meter fuel flow to engines having main combustion chambers and precombustion chambers. Further, in such carburetor structures, the prior art has heretofore been unable to provide means for assuring that a proper and sufficient amount of fuel is always available, during all conditions of engine operation and all variations of physical attitudes which such carburetor structure may assume, for the proper metering of fuel to both the engine combustion chamber means and precombustion chamber means.

The invention as herein disclosed and described is primarily directed to the solution of the above as well as other related and/or attendant problems.

SUMMARY OF THE INVENTION

According to the invention, in one aspect thereof, a fuel supply system for a carburetor for an internal combustion engine having main combustion chamber means and precombustion chamber comprises first fuel reservoir means effective for supplying fuel to said combustion chamber means, second fuel reservoir means effective for supplying fuel to said precombustion chamber means, float means situated in said first reservoir means and responsive to the level of the fuel within said first reservoir means, and first and second series arranged fuel inleet valve means operatively connected to said float means and effective for admitting fuel from associated fuel source means to said first and second fuel reservoir means, said second fuel inlet valve means being effective during a first range of operating conditions to effectively divert at least a substantial portion of such fuel flow pasing through said first fuel inlet valve means from said first fuel reservoir means and to said second fuel reservoir means, and said second fuel inlet valve means being effective during a second range of operating conditions to admit into said first fuel reservoir means at least a substantial portion of such fuel flow passing through said first fuel inlet valve means while still diverting a portion of such fuel flow to said second fuel reservoir means.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF PREFERRED EMBODIMENT

Figure 1:
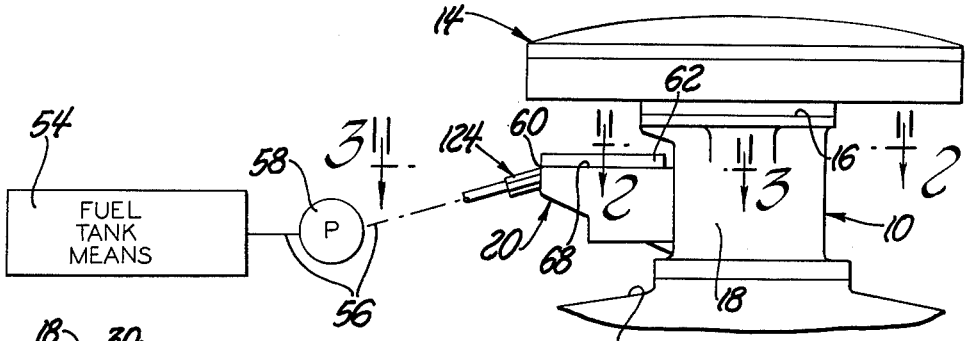
FIG. 1 is a side elevational view of a carburetor structure, embodying teachings of the invention, shown situated atop an intake manifold of an associated internal combustion engine.

Referring now in greater detail to the drawings, FIG. 1 illustrates a carburetor 10 situated atop the inlet of a intake manifold 12 of an associated internal combustion engine. An inlet air cleaner assembly 14 is shown situated atop the inlet end 16 of the carburetor assembly 10.

In the specific embodiment illustrated, the carburetor assembly is one of the type which supplies metered fuel to a stratified charge type engine often referred to as a "CCV" engine employing precombustion chamber means operatively interconnected to the combustion chamber means within the respective engine cylinders above the engine pistons therein.

Figure 2:
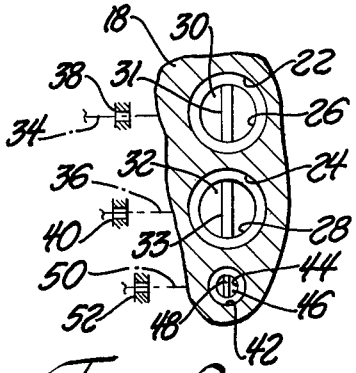
FIG. 2 is a fragmentary cross-sectional view taken generally on the plane of line 2—2 of FIG. 1 and looking in the direction of the arrows.

In the embodiment illustrated, the carburetor body or housing means 18 comprises fuel bowl or reservoir means 20 and also defines a pair of induction passage or bore mens 22 and 24 which, as is well known in the art respectively comprise venturi means 26 and 28 and pivotally variably positionable throttle valve means 30 and 32 respectively carried as by throttle shaft means 31 and 33. As schematically shown in FIG. 2, conduit means 34 nd 36, each communicating with the fuel within the chamber of the fuel bowl assembly 20, respectively lead to main induction passages 22 and 24. Suitable calibrated restriction means 38 and 40 serve to meter the rate of fuel flow through conduits 34 and 36. In fact, as is well known in the art, restriction means 38 and 40, shown as being separate and distinct from each other, may actually be a single restriction means through which fuel is metered to both induction passages 22 and 24.

A precombustion induction passage means 42, generally similar to either bore 22 or 24, is of considerably reduced transverse cross-sectional flow area and comprises a venturi 44 and pivotally or rotatably variably positionable throttle valve means 46 carried therein as by a related throttle shaft 48. A conduit means 50 with calibrated restriction means 52 therein communicates generally between the bore or induction passage 42 and the fuel within the fuel bowl chamber or assembly 20. Induction passage means 42 serves to supply metered fuel and air flow to the precombustion chamber means within the associated engine. As should be evident in the art, the volume or weight rate of metered fuel flow, from the precombustion induction passage means 42 to the precombustion chamber of the engine, is small as compared to the volume or weight rate of metered fuel flow provided by the induction passage means 22 and 24 to the engine cylinder combustion chambers.

As generally depicted in FIG. 1, suitable related fuel tank means 54, containing a supply of fuel, serves to supply such fuel via conduit means 56 and fuel pump means 58 to the inlet 60 of the fuel bowl or reservoir assembly 20. Further, as also shown in FIG. 1, the fuel bowl assembly 20 may comprise a removable upper situated cover means 62 suitably secured in assembled relationship as by screws 64 and 66 portions of which are illustrated in FIG. 3. 21

Figure 3:
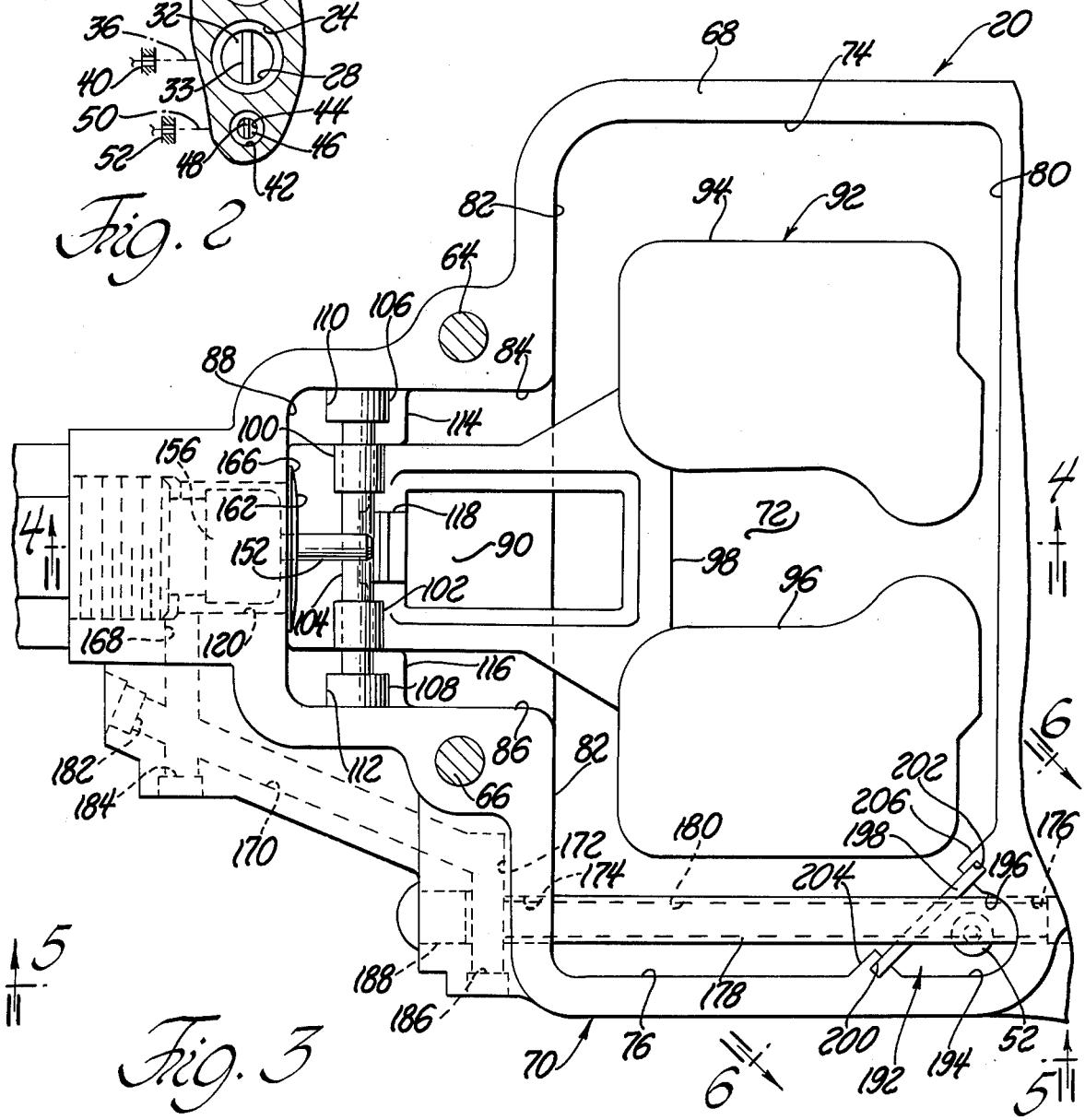
FIG. 3 is an enlarged view taken generally on the plane of line 3—3 of FIG. 1 and looking in the direction of the arrows.

FIG. 3 is an enlarged fragmentary view taken generally on the plane of line 3—3, of FIG. 1, passing generally co-planar with the upper surface 68 of the fuel bowl assembly 20.

Figure 4:
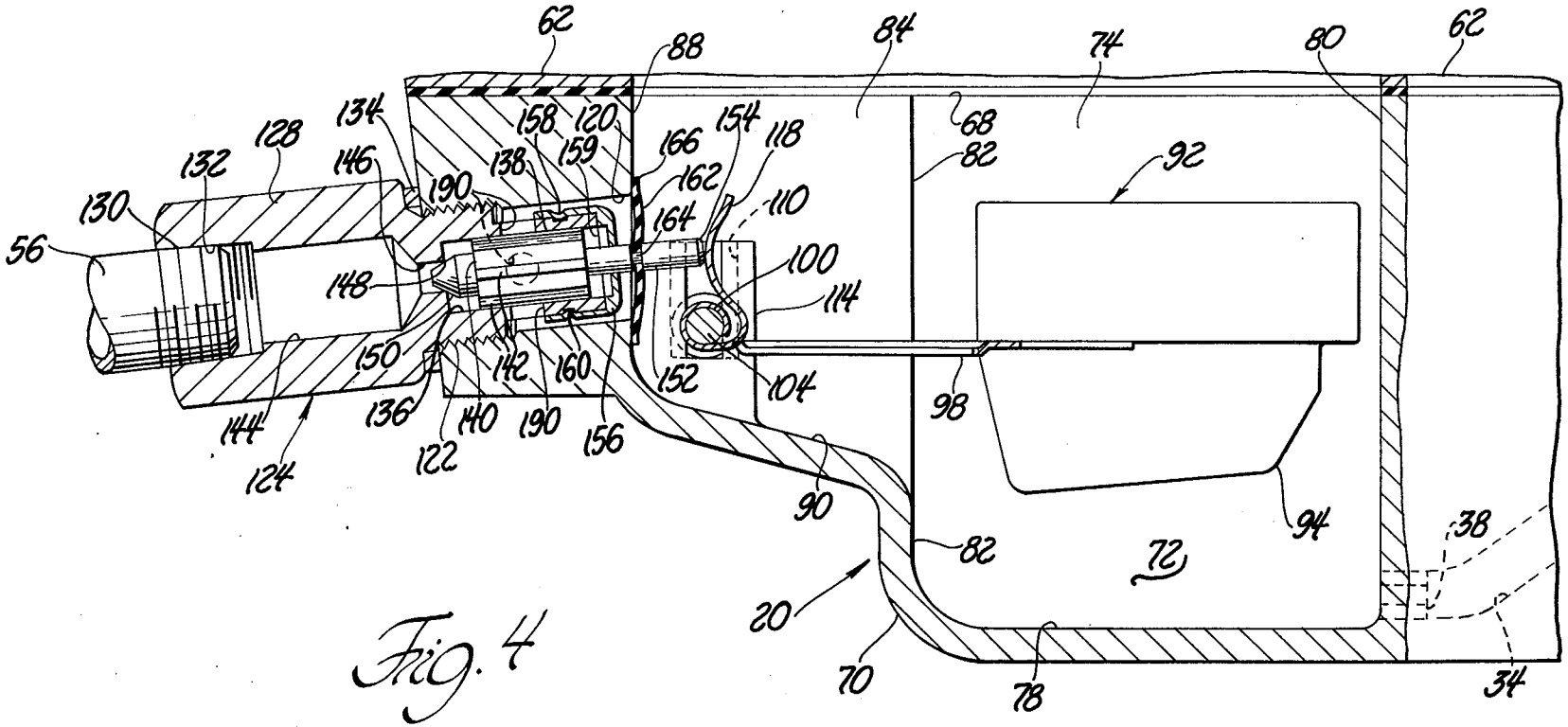
FIG. 4 is a cross-sectional view taken generally on the plane of line 4—4 of FIG. 3 and looking in the direction of the arrows.
Figure 5:
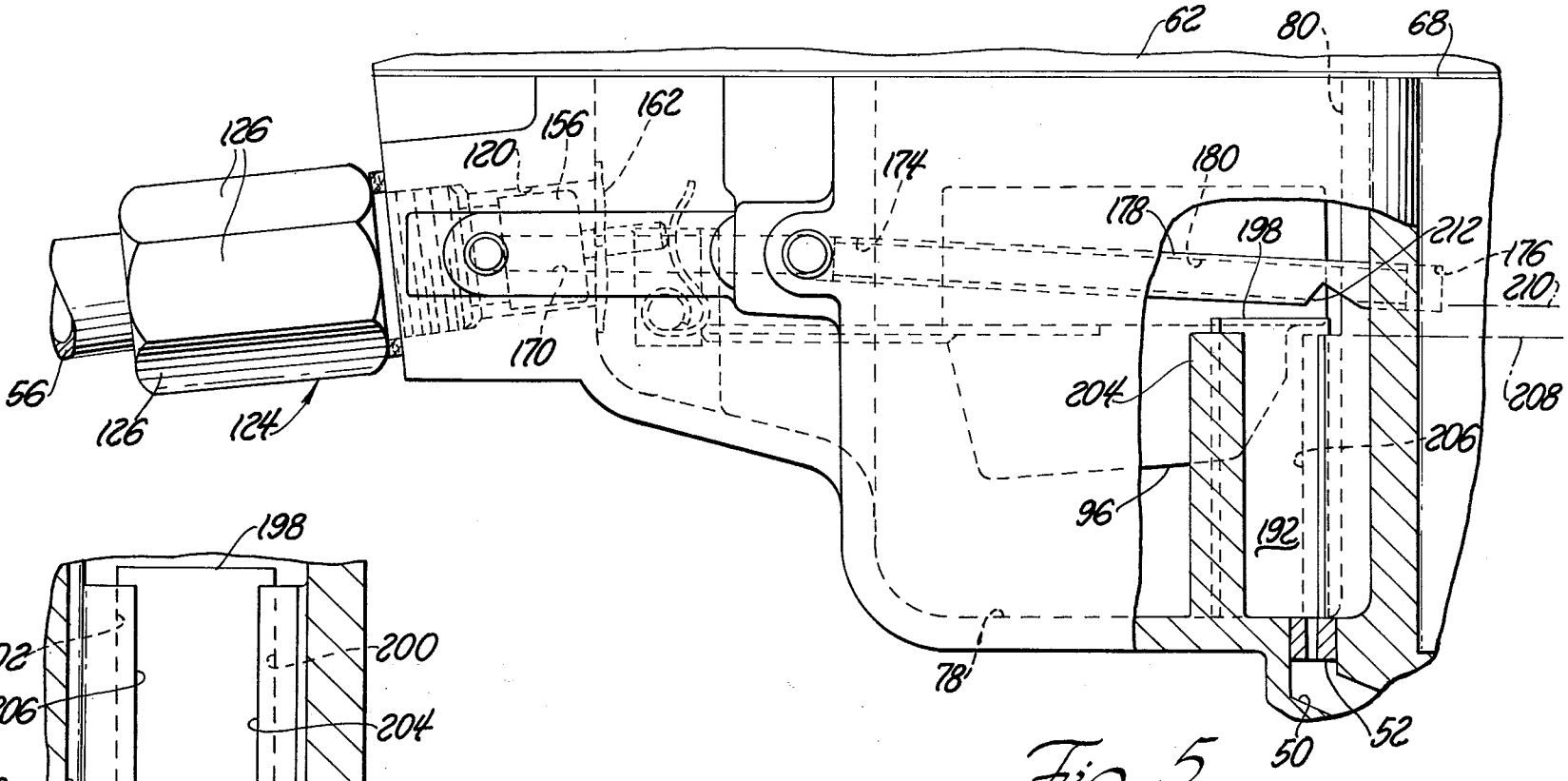
FIG. 5 is a side elevational view taken generally on the plane of line 5—5 of FIG. 3 and looking in the direction of the arrows.
Figure 6:
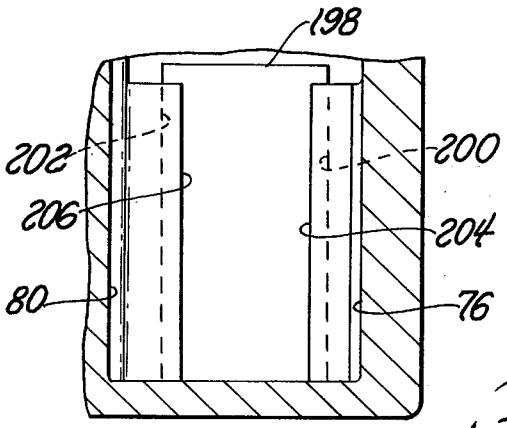
FIG. 6 is a cross-sectional view taen generally on the plane of line 6—6 of FIG. 3 and looking in the direction of the arrows.

Referring to FIGS. 3, 4 and 5, it can be seen that the fuel bowl assembly 20 comprises a fuel bowl body portion 70 with a fuel chamber 72 formed therein and defined generally by opposed end walls 74 and 76 integrally formed with a bottom wall 78, forwardly disposed transverse wall 80 and rearwardly disposed transverse wall 82. A rearwardly directed extension of chamber 72 is similarly defined by opposed end or side walls 84, 86 transverse wall 88 and lower or bottom wall 90. A float structure 92, contained within chamber 72, is comprised of buoyant float members 94 and 96 each suitably fixedly secured to a plate-like member 98 which, at its other end, has oppositely disposed integrally formed tubular journal or bearing portions 100 and 102 rotatably receiving therethrough pivot means 104. Enlarged cylindrical end portions 106 and 108 are respectively received within T-like slots 110 and 112 formed within boss-like portions 114 and 116 integrally formed along walls 84 and 86. A generally medially situated curvilinear lever-like extension or arm 118 is also integrally formed on float plate 98 as to rotate counter-clockwise about the axis of pivot 104 whenever, generally, the float members 94 and 96 are moved upwardly by an increasing level of liquid (in this instnce, fuel) within chamber 72.

Wall 88 has a passage 120 formed therethrough with a portion of such passage being internally threaded as to threadably receive an externally threaded portion 122 of a valve and housing assembly 124 which, as shown in, for example, FIG. 5, may be provided with flatted external tool-engaging surfaces 126. The main body 128 of assembly 124 may be operatively connected to fuel delivery conduit means 56 as by cooperating external and internal threaded portions 130 and 132. As shown, annular sealing means 134 may be provided as to prevent any possible leakage through the threaded portion 122.

The main body 128 has a generally tubular extension with an internal cylindrical passage 136 which slidably receives an axially positionable liquid or fuel inlet valve 138 having a valve body 140, which may be of a generally rectangular or diamond transverse cross-sectional configuration with outer angularly spaced axially extending cylindrical surfaces 142 for slidably engaging with passage 136.

As best shown in FIG. 4, the tubular extension 159 is also provided with a plurality of angularly spaced radially directed apertures or ports 190 which serve to continually complete communication as between chamber or passage 136 and chamber -like passage 120.

As shown in FIGS. 3 and 5, a second weir-like reservoir 192 is formed generally within the overall interior fuel bowl chamber 72 but as to be distinct therefrom. That is, the reservoir 192 may be defined generally in a corner of the overall chamber 72 as to thereby have wall portions 194 and 196 of the chamber define a portion of the vertically extending reservoir 192 while a closure of such corner area can be affected as by a removable wall panel member 198 preferably tightly received within opposed guide-like receiving slots 200 and 202 respectively formed in protruding portions 204 and 206 of walls 76 and 80. Although the lower end or edge of panel 198 need not form a perfect seal with respect to the lower wall 78 it nevertheless serves to seal and effectively separate the precombustion fuel reservoir 192 from the remaining portion of the reservoir chamber 72.

In the preferred embodiment of the invention, if the effective height of the walls defining and separating the chamber or reservoir 192 from the remaining portion of fuel bowl chamber 72 is depicted by elevation line 208, then the normal fuel level within the fuel bowl chamber 72 would be some distance above line 208 as generally depicted by, for example, elevation line 210.

Further, as best shown in FIG. 5, the tube member 178 has a notch-like opening 212 formed therein at the underside thereof as to be disposed generally directly above the top of precombustion chamber fuel reservoir 192. Passages or conduits 144 and 146 serve to complete communication as between conduit 56 and passage 136. An annular seat 148 cooperates with valving surface 150 to variably restrict liquid flow from conduit 146 to chamber 136. A valve stem or extension 152 extends axially from valve body 140 as to have the free end 154 thereof juxtaposed to arm 118. A cup shaped baffle member 156, operatively secured to the end of the tubular extension of body 128 as by an annular indention 158 received within a cooperating annular groove or recess 160, has an aperture formed therein for closely slidably receiving therethrough valve stem 152. A generally bowed disc-like elastomeric member 162 has an aperture formed therethrough generally centrally thereof. In its free state, the centrally disposed aperture is of a size as to closely and tightly receive a neck-down or reduced portion 164 of valve stem 152. With the valve 138 being in the position depicted, that is, fully or nearly fully closing flow from conduit 146 to chamber 136, the outer periphery 166 of the elastomeric member is correspondingly most tightly held against the surface of wall 88 thereby achieving a degree of sealing action therewith.

As best shown in FIGS. 3 and 5, the fuel bowl body 70 is also provided with a plurality of interconnected conduit means. That is, a first conduit 168 completes communication between chamber 120 and a second conduit 170 which, in turn, communicates with a conduit 172. A first passage-like portion 174 formed into wall 88 and a second aligned blind passage-like portion 176 formed into opposite wall 80 serve to generally tightly receive and support a tubular conduit member 178 the interior 180 of which is in communication with conduit 172. Sealing or capping-like plugs 182, 184, 186 and 188 may be provided, as shown, in order to respectively close the otherwise open ends produced during the machining of such conduits.

OPERATION OF THE INVENTION

Generally, fuel supplied by the fuel tank means 54 is pumped as by pump means 58 through conduit means 56 to the inlet valve assembly means 124 which, controlled by the float means 92, permits a controlled rate of fuel flow into the fuel bowl chamber 72. As fuel is thusly delivered to the chamber 72 the level of such fuel continues to rise until the level attains a predetermined elevation, as depicted by line 210, at which time the float means 92, through the lever 118, causes valve surface 150 of valve member 138 to be seated closed against cooperating valve seat 148 thereby terminating further flow of fuel. It should be noted that because of the lower upper height of the weir walls of reservoir 192, as depicted by line 208, the fuel from the remaining portion of the bowl chamber 72 can spill over into reservoir 192 as the level of the fuel within bowl chamber exceeds the level of line 208. In other words, in the filling of the entire fuel bowl chamber 72 to the normal level, the reservoir 192 becomes submerged.

The provision of a weir-like wall, as comprised by wall portions 204, 198 and 206, provides an important benefit. That is, the fuel within the weir reservoir 192 does not unduely spill out or flow away from the conduit 50 and metering means 52 even when the carburetor undergoes severe changes in attitude as may well occur when the associated vehicle experiences sharp turns or changes in direction of travel, panic type sudden braking or rapid acceleration. In other words, even though, as wth the vehicle experiencing a sudden change in its attitude, the fuel within the remaining portion of the fuel bowl chamber 72 may be forced (by centrifugal force or inertia) away from the weir and, for example, toward wall 74. Consequently, there is always an assurance that a sufficient quantity of fuel exists in reservoir 192 to supply the required rate of fuel flow to the precombustion chamber induction passage 42.

Another important feature of the invention is the means and manner of assuring a sufficient flow of fuel to the reservoir 192.

As should be evident, the sealing force exhibited by the periphery 166 of elastomeric member 162 is dependent, as one factor, upon the degree to which such a member 162 has been pressed and resiliently deflected against wall 88 which, in turn, is dependent on how far toward fully closed position valve 138 has been moved by float means 92 and actuating tang or lever 118. Therefore, it follows that as the level of the fuel within bowl chamber 72 increases and approaches the desired normal level 210 the sealing force exhibited by seal member 162 also increases. During engine operation requiring relatively low rates of metered fuel flow from the fuel bowl assembly to the engine, the level of the fuel within the bowl assembly will remain close to or at the level designated at 210 and fuel will continually tend to spill over from the remainder of chamber 72 and into reservoir 192. However, because of any one of a number of factors, as for example, high rate of fuel consumption, causing the lowering of the effective level of the fuel within the remainder of chamber 72 to an effective level below that designated by level or elevational line 208, additional means are provided for assuring a continuous supply of fuel to reservoir 192. Such means comprise conduit means 168, 170, 172 and 180 through which fuel will flow and through aperture or port 212 down into reservoir chamber 192.

That is, at very low rates of fuel flow the pressure drop across coacting valve seat 148 and valve surface 150 is the greatest causing the fuel downstream of the valve surface 150 to be at a very low pressure which, after flowing through ports 190 and into chamber or passage 120, is insufficient to significantly resiliently move the sealing periphery 166 of valving member 162 away from coacting wall 88. Therefore, effectively, passage 120 then acts as a closed chamber communicating with conduits 168, 170 and 172 thereby supplying fuel flow to tube conduit 180 and, through aperture 212, into reservoir 192. Accordingly, a proper and sufficient supply of fuel within reservoir 192 is continually assured for the proper metering therefrom to the precombusion chamber induction passage means 42. If for any reson the fuel thusly supplied to reservoir 192 exceeds the volume which reservoir 192 is able to contain, such excess will merely spill over into the remainder of the overall fuel bowl chamber reservoir 72 and thereby add to the fuel level therein tending to move float means 92 upwardly as to thereby more nearly close needle valve surface 150 against valve seat 148. In other words, the fuel supply system branching to the reservoir 192 is part of a closed loop feed-back system which is effective for reducing the rate of fuel supply once that rate exceeds the then existing demand.

It should also now be apparent that as the rate of metered fuel flow from the remainder of the reservoir 72 and through metering means 38, 40 increases the level of the fuel within the fuel bowl reservoir 72 will decrease causing float means 92 to move generally downwardly resulting in valve 138 becoming more nearly fully opened by moving away from valve seat 148. As a consequence, the resilient force holding or tending to hold the periphery 166 of valve member 162 against wall or face 88 is reduced while the pressure of the fuel downstream of valve seat 148 is increased because of valve surface 150 having moved further away from seat 148. Because of this, the fuel supplied to and within passage-chamber 120 causes at least a portion of the periphery 166 of valve-like member 162 to be resiliently deflected away from the wall or face 88 and such fuel passes as between such resiliently deflected portion and wall 88 into the main portion or reservoir 72. During this time, not only does the higher rate of fuel supplied flow into the main portion of reservoir 72 but it also flows through the parallel path previously described to chamber or secondary reservoir 192.

The invention has been disclosed and described as it can be practiced with respect to fuel bowl assembly of a carburetor structure. However, it should be apparent that, for example, the inventive valving means and liquid supply means herein disclosed may be practiced with respect to any fluid supply system environment in need thereof.

Although only a preferred embodiment of the invention has been disclosed and described, it is apparent that other embodiments and modifications of the invention are possible within the scope of the appended claims.

I claim:

1. A fuel supply system for a carburetor for an internal combustion engine having main combustion chamber means and precombustion chamber means, said fuel supply system comprising first fuel reservoir means effective for supplying fuel to said combustion chamber means, second fuel reservoir means effective for supplying fuel to said precombustion chamber means, float means situated in said first reservoir means and responsive to the level of the fuel within said first reservoir means and first and second series arranged fuel inlet valve means operatively connected to said float means and effective for admitting fuel from associated fuel source means to said first and second fuel reservoir means, said second fuel inlet valve means being effective during a first range of operating conditions to effectively divert at least a substantial portion of such fuel flow passing through said first fuel inlet valve means from said first fuel reservoir means and to said second fuel reservoir means, and said second fuel inlet valve means being effective during a second range of operating conditions to admit into said first fuel reservoir means at least a substantial portion of such fuel flow passing through said first fuel inlet valve means while still diverting a portion of such fuel flow to said second fuel reservoir means.

2. A fuel supply system according to claim 1 and further comprising cover wall means generally situated over said first fuel reservoir means and said second fuel reservoir means, wherein said first fuel reservoir means and said second fuel reservoir means share common wall means generally therebetween, and further comprising a clearance space generally between said common wall means and sid cover wall means as to at times permit fuel to spill therethrough from said second fuel reservoir means to said first fuel reservoir means.

3. A fuel supply system according to claim 2 wherein said common wall means is removable.

4. A carburetor for a combustion engine, comprising body means, fuel reservoir chamber means formed in said body means, said fuel reservoir chamber mens comprising a first fuel chamber and a second fuel chamber, first and second conduit means leading respectively from said first fuel chamber and said second fuel chamber to associated fuel consuming means, said first fuel chamber defining a relatively large volume for the storage of fuel therein and said second fuel chamber defining a relatively small volume for the storage of fuel therein, said second fuel chamber comprising a generally vertically extending well-like chamber with an upper disposed passage providing for communication as between said well-like chamber and said first fuel chamber, fuel inlet valve means for directing fuel flow to said well-like chamber and to said first fuel chamber, float means responsive to the level of said fuel within said first fuel chamber to terminate fuel flow through said inlet valve means when said level attains a preselected elevation, and additional resilient valve means for preventing all of the fuel flowing through said inlet valve means from entering into said first fuel chamber and instead causing at least a portion thereof to enter said well-like chamber.

* * * * *

UNITED STATES PATENT OFFICE

CERTIFICATE OF CORRECTION

Patent No. 4,034,026 Dated July 5, 1977

Inventor(s) Robert J. Miller

It is certified that error appears in the above-identified patent and that said Letters Patent are hereby corrected as shown below:

Assignee: Colt Industries Operating Corp
New York, N. Y.

Signed and Sealed this

Twentieth Day of September 1977

[SEAL]

*Attest:*

RUTH C. MASON
*Attesting Officer*

LUTRELLE F. PARKER
*Acting Commissioner of Patents and Trademarks*